United States Patent [19]

Walters

[11] 4,441,775

[45] Apr. 10, 1984

[54] COUPLING AND DECOUPLING AID FOR AN ELECTRICAL CONNECTOR

[75] Inventor: Gerald E. Walters, Granada Hills, Calif.

[73] Assignee: Automation Industries, Inc., Greenwich, Conn.

[21] Appl. No.: 406,329

[22] Filed: Aug. 9, 1982

[51] Int. Cl.[3] ..... H01R 13/62

[52] U.S. Cl. ..... 339/89 R

[58] Field of Search ..... 81/90 B, 90 C, 64; 285/38, 39; 339/89, 90

[56] References Cited

U.S. PATENT DOCUMENTS

| | | | |
|---|---|---|---|
| 3,678,789 | 7/1972 | Wilson | 81/64 |
| 3,760,659 | 9/1973 | Campbell | 81/90 C |
| 3,837,244 | 9/1974 | Schera, Jr. | 81/64 |

*Primary Examiner*—Joseph H. McGlynn
*Assistant Examiner*—Paula Austin
*Attorney, Agent, or Firm*—Francis N. Carten

[57] ABSTRACT

A wire frame aid is received over the cable and the connector part that carries the coupling housing. At one end of the frame coded keys interlockingly engage keys and keyways on the outer surface of the coupling housing. The aid is gripped by one or both hands when it is desired to rotate the housing providing greater purchase of the hand and additional leverage for opening or closing the connector, as the case may be. An elongated slot-like opening enables the aid to be slipped on and off the cable and connector, as desired. In a second version, an elongated hollow metal body having a bore sufficient to permit receipt onto the cable has an enlarged threaded end which is received onto a similarly threaded portion of the coupling housing. The end portion of the metal body opposite the threaded end is provided with transversely extending parts which can be gripped with the hand or fingers, or with a suitable tool during use.

6 Claims, 8 Drawing Figures

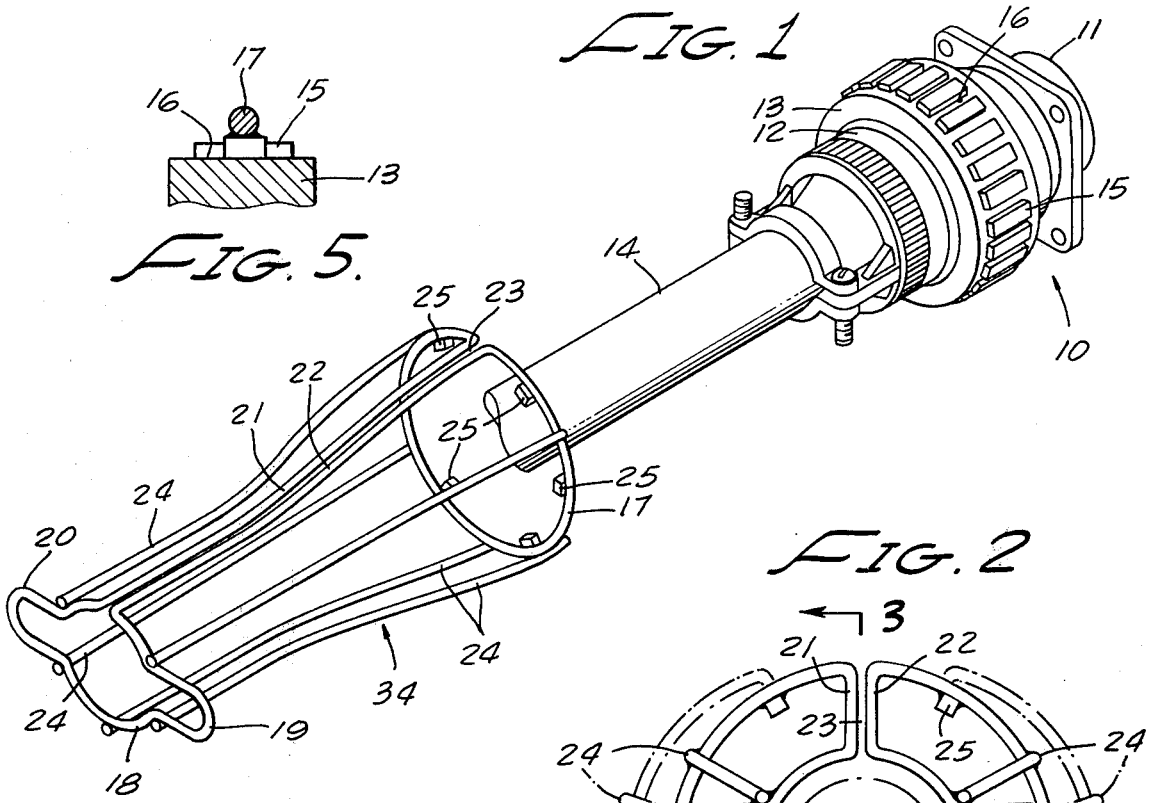
FIG. 5.
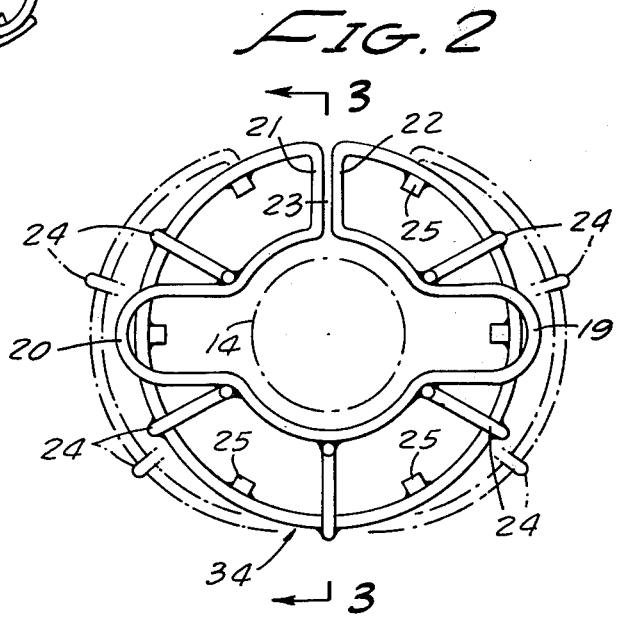
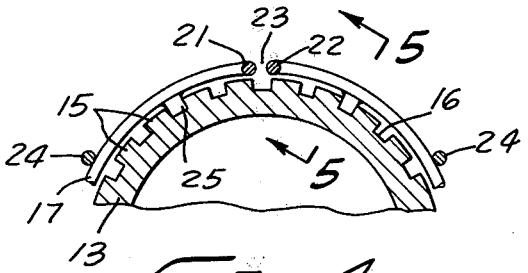
FIG. 4.
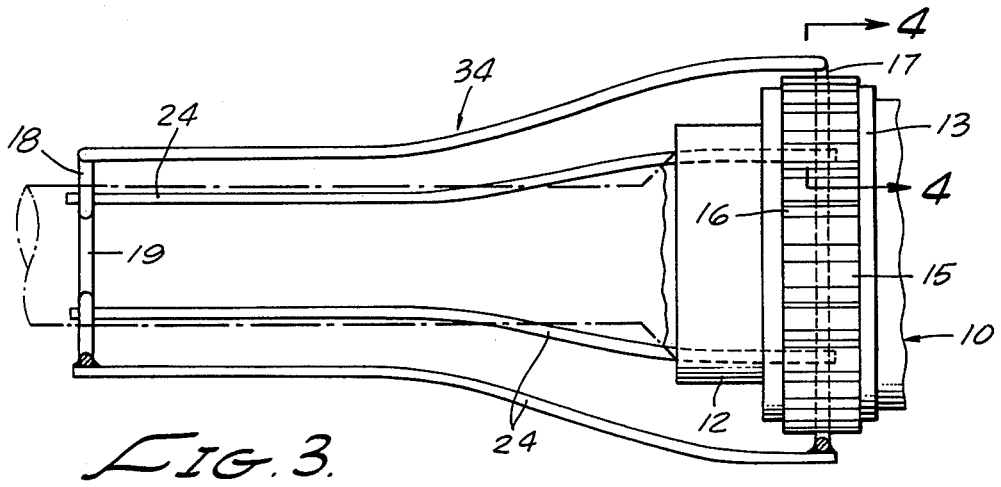
FIG. 3.

COUPLING AND DECOUPLING AID FOR AN ELECTRICAL CONNECTOR

The present invention pertains generally to an electrical connector, and more particularly to an aid for coupling and decoupling an electrical connector of the plug and receptacle variety.

BACKGROUND OF THE INVENTION

In U.S. Letters Pat. No. 4,066,315-by McCormick--there is described a quick-connect and quick-disconnect electrical cable connector with plug and receptacle parts which by rotation of a coupling housing are lockingly intermated and released, depending on the direction of rotation. This connector is widely used wherever releasable interconnection of electrical and electronic equipment is desired. In the large versions of this connector, a special wrench or spanner is required for rotating the coupling housing when connecting or disconnecting the connector. Even in the more modest sized connectors, a substantial amount of hand force is required to connect and disconnect the electrical parts, the application of which can be made more difficult by temperature extremes. Also, at times the cables leading to the various connector parts may be canted with respect to each other applying a transverse force to the connector which makes it even more difficult to release (or mate).

SUMMARY OF THE INVENTION

In a first form of the described coupling and decoupling aid, a wire frame is received over the cable and the connector part that includes the coupling housing. Means are provided at one end of the frame for being received in interlocking engagement with keys and keyways on the outer surface of the coupling housing. The wire frame aid is gripped by one or both hands when it is desired to rotate the housing and in that way providing greater purchase of the hand and additional leverage for opening or closing the connector, as the case may be. The frame is constructed with an elongated slot-like opening so that the frame aid may be slipped on and off the cable and connector, as desired.

In accordance with a second version of the invention, an elongated hollow metal body having a bore sufficient to permit receipt onto the cable has an enlarged threaded end which is received onto a similarly threaded portion of the coupling housing. The end portion of the metal body opposite the threaded end is provided with transversely extending parts which can be gripped with the hand or fingers, or with a suitable tool. In use, the aid body is gripped by hand or with a tool and rotated in the proper direction for disconnecting or connecting the connector parts, as the case may be.

DESCRIPTION OF THE DRAWINGS

FIG. 1 is a perspective view of a plug and receptacle connector showing a first form of the coupling and decoupling aid located adjacent the connector FIG. 2 is an end elevational view of the coupling and decoupling aid of FIG. 1.

FIG. 3 is a side elevational, sectional view, partially in phantom, taken along the line 3—3 of FIG. 2.

FIG. 4 is a sectional, elevational, partially fragmentary view taken along the line 4—4 of FIG. 3.

FIG. 5 is a fragmentary sectional view taken along the line 5—5 of FIG. 4.

DESCRIPTION OF PREFERRED EMBODIMENTS

Figure 6:
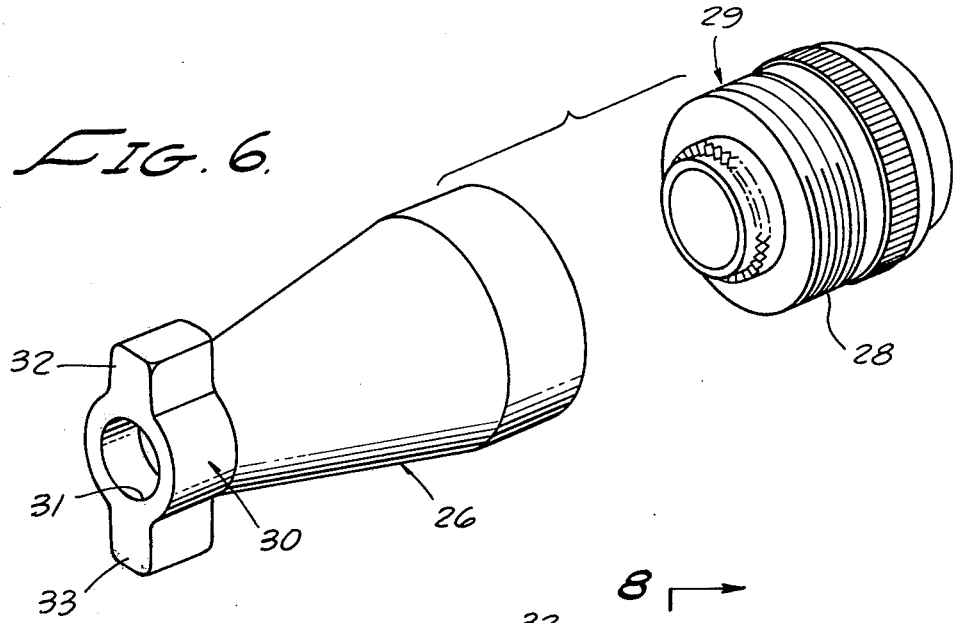
FIG. 6 is a perspective view of an alternate embodiment of the coupling and decoupling aid showing the aid located adjacent to the electrical connector.

In FIG. 1 of the drawing there is shown an electrical connector enumerated generally as at 10 typically including a receptacle 11 and a plug 12 which are mateable together to effect electrical connection between cable wires via pin and socket contacts carried by the respective connector parts. More particularly, a generally cylindrical coupling housing 13 carried by the connector part plug is rotated to connect and disconnect the connector parts depending upon the direction of rotation. A cable 14 to be connected is received within the end of plug 12 and a further cable (not shown) is received within the end of the receptacle 11. A frequently encountered construction for the coupling ring or housing 13 is one of a generally cylindrical shell having a plurality of spaced ridges or keys 15 with intervening keyways 16 arranged in a circumferential path about the coupling housing periphery.

The coupling and decoupling aid depicted generally as at 16 is seen to include an elongated hollow framework adapted for receipt onto and over the cable 14 as well as portions of the coupling housing 15. More particularly, a single wire is formed into a first generally cylindrical end 17 and an opposite end 18 of irregular shape spaced from 17 and generally parallel thereto. The end 18 has a substantially cylindrical center portion and two wing-like extensions 19 extending from opposite sides thereof. A pair of interconnecting wire members 21 and 22 integral with the wire forming ends 17 and 18 extend between the ends 17 and 18 and maintained apart throughout the entire length as at 23 for a reason and use to be described.

A plurality of supporting or reinforcing wire members 24 extend between the two ends 17 and 18 and are secured (e.g., welding) to each of the ends. The side wires 24 are also formed so as to provide a continuously curved side wall envelope extending from the circular end 17 to the irregularly shaped end 18. A plurality of generally rectangular lugs 25 are secured to the inwardly directed surface of the circular end 17 as by welding, for example. These lugs are of such dimensions and so arranged that the end 17 can be fitted directly onto the coupling housing 13 with the individual lugs 25 fitting into the coupling keyways 16.

When the aid is fully received onto the connector (FIG. 3) the circular end 17 is releasably but lockingly received onto the coupling housing 13 and the remainder of the aid 10 extends away from the connector in surrounding relationship to the cable. The aid may now be firmly gripped with the hand for rotating and the extensions 19, 20 on the side of the irregular face 18 serving to provide additional purchase or leverage. Also, by the use of spring wire in constructing the aid 16, the gap 23 between the adjacent wire elements 21 and 22 may be opened sufficiently to enable receipt onto the cable after it is fully connected to the plug. Still further, the spring action of the end 17 serves to hold the end 17 and lugs 25 on the coupling housing.

Figure 7:
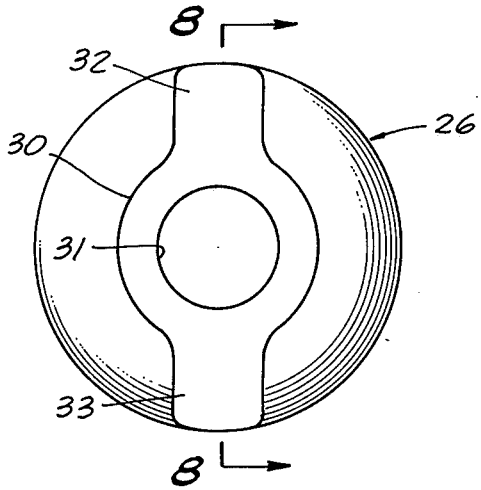
FIG. 7 is an end elevational view of the coupling and decoupling aid of FIG. 6.
Figure 8:
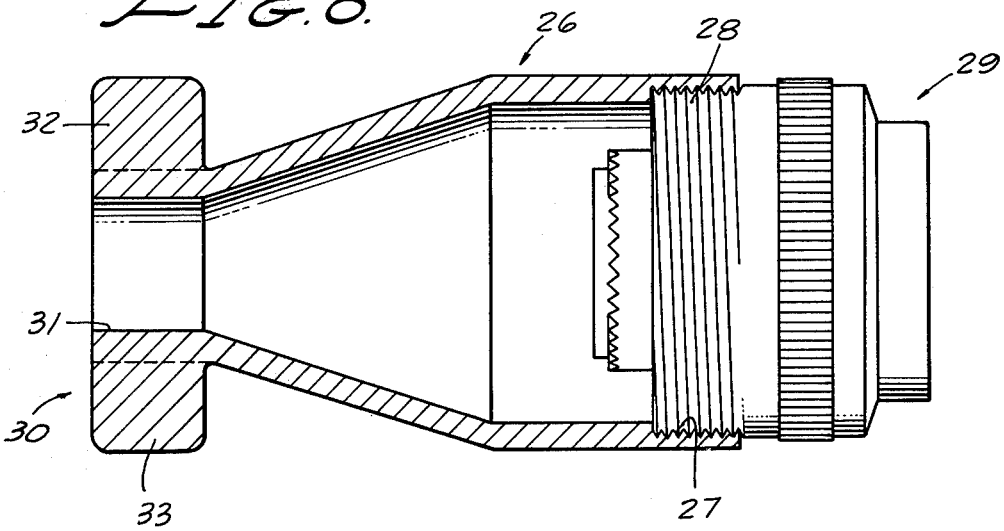
FIG. 8 is a side elevational, sectional view taken along the line 8—8 of FIG. 7.

FIGS. 6 through 8 show an alternate form of the coupling and decoupling aid enumerated generally as at 26 consisting of a one-piece construction having at its larger end a circular threaded opening 27 for receipt upon a similarly threaded end 28 of a connector plug 29. The remainder of the aid body tapers down from the threaded end to a smaller opposite end 30, the exit opening 31 of which is of a cross-sectional dimension sufficient to receive the cable 14 therethrough. First and second generally rectangular extensions 32 and 33 extend at opposite sides of the small end 30 and are adapted for having tools such as wrenches being applied thereto to apply a rotative force to the aid body.

As can be seen best in FIG. 8, the aid 26 has a continuous cavity extending from the larger open end 27 through to the smaller end opening 31. In use, the aid 26 is received onto the cable 14 prior to the cable being affixed to the plug 29 and after which the aid is then threaded onto the plug end 28. The outside surface of the aid is smooth and is of such length as to enable one or both hands to be applied thereto for engaging or disengaging the plug 29 from the corresponding receptacle connector part. Alternatively, one hand may be used in gripping relation to the main shank of the aid 26 and fingers of the other hand or a tool may be applied to the extensions 32 and 33.

I claim:

1. An aid for use in coupling and decoupling a plug and receptacle connector, the plug having a coupling housing that is rotatable to couple and decouple the connector depending on the direction of rotation, and a cable connected to the plug, comprising:

a member adapted for holding in the hand with a bore extending therethrough having a first opening of sufficient size to enable receipt onto the coupling housing and a second opening of sufficient size to enable receipt onto the cable;

means on an interior wall of the member defining the first opening for releasably engaging the coupling housing; and first and second means extending from opposite sides of the member immediately adjacent and transversely of the member second opening.

2. An aid as in claim 1, in which the member is constructed of springlike wire elements formed into a frame.

3. An aid as in claim 2, in which the frame includes a slotlike opening in a wall extending the full length of the member, the springlike characteristics of the wire elements being such that the slotlike opening can be distended to enable receipt of the cable within the member bore.

4. An aid as in either claim 1 or 2, in which the releasably engaging means includes at least one lug which is fittingly received within a keyway on the outer surface of the coupling housing.

5. An aid as in claim 1, in which the member first opening is threaded for engagement with a similarly threaded portion of the coupling housing.

6. An aid as in claim 5, in which the member and first and second means extending from the member are an integral one-piece cast construction.

* * * * *